US006105481A

United States Patent [19]

Schuler

[11] Patent Number: 6,105,481

[45] **Date of Patent: *Aug. 22, 2000**

[54] FOIL DISPENSER

[76] Inventor: Pius Schuler, Kirchweg 16, CH-6048 Horw, Switzerland

[ * ] Notice: This patent issued on a continued prosecution application filed under 37 CFR 1.53(d), and is subject to the twenty year patent term provisions of 35 U.S.C. 154(a)(2).

[21] Appl. No.: 08/973,956

[22] PCT Filed: May 15, 1996

[86] PCT No.: PCT/CH96/00187

§ 371 Date: Nov. 17, 1997

§ 102(e) Date: Nov. 17, 1997

[87] PCT Pub. No.: WO96/36551

PCT Pub. Date: Nov. 21, 1996

[30] Foreign Application Priority Data

May 15, 1995 [CH] Switzerland ..... 1405/95

[51] Int. Cl.[7] ..... B26D 1/04

[52] U.S. Cl. ..... 83/578; 83/614; 83/649; 83/949

[58] Field of Search ..... 83/578, 614, 649, 83/650; 225/39, 43

[56] References Cited

U.S. PATENT DOCUMENTS

| | | | |
|---|---|---|---|
| 2,295,648 | 9/1942 | Gillanders et al. | 83/614 |
| 2,823,969 | 2/1958 | Traver et al. | 83/614 |
| 2,978,156 | 4/1961 | Yaniello | 225/43 |
| 3,142,217 | 7/1964 | Busse | 83/649 |
| 3,142,426 | 7/1964 | Busse | 83/649 |
| 3,240,093 | 3/1966 | Bell, Jr. et al. | 83/614 |
| 3,748,939 | 7/1973 | Feinstein et al. | 83/614 |
| 3,998,120 | 12/1976 | Granger et al. | 83/649 |
| 4,156,382 | 5/1979 | Baker | 83/614 |
| 4,197,774 | 4/1980 | Singh et al. | 83/374 |
| 4,619,169 | 10/1986 | King | 83/578 |
| 5,036,740 | 8/1991 | Tsai | 83/614 |
| 5,398,576 | 3/1995 | Chiu | 83/614 |

*Primary Examiner*—Rinaldi I. Rada
*Assistant Examiner*—Kim Ngoc Tran
*Attorney, Agent, or Firm*—Edwin D. Schindler

[57] ABSTRACT

The housing (11) of a roll of foil consists of a housing body (12) with a roll chamber and a holder guide and a cover plate (13), a holder guide cover (14) and a roll chamber cover (15*a*). The roll chamber has a dispensing slot (22) and the holder guide has a cutting slot (23). A cutting blade (17) protects through the cutting slot (23) and is fitted on a blade holder guided in the holder guide. With the housing (11) sufficiently inclined, the blade (17) moves under the force of gravity along the cutting slot (23) and cuts off the unrolled section of foil (10). Before, during and after cutting, the housing is held with one hand and the unrolled foil section (10) with the other.

7 Claims, 2 Drawing Sheets

FOIL DISPENSER

The invention relates to a foil dispenser for storing a web of foil coiled into a roll, and for cutting off and dispensing end sections of the web of foil, according to the introductory part of patent claim 1.

Foils, especially plastic foils, are consumed in large quantities in households and restaurant operations for various purposes. So-called catering foil material is commonly used for covering containers with prepared meals or meal leftovers, or for packaging foodstuffs. Such foil materials are available with different foil thicknesses. In addition, foils are available which are resistant to microwave oven and/or baking oven heat, or which ate particularly suitable for packaging deep-frozen foods. Furthermore, biodegradable foil materials are known, which need not to be incinerated after their use, but which can be composted. For ecological reasons, such plastic foils are to be preferred in any case over aluminum foil, which is used for similar purposes. Aluminum foil is often used only because it is easier to handle. Even though plastic foil as such is appreciated as an extremely practical auxiliary material, problems arise when foil sections are unrolled and cut from a roll of endless foil material coiled in the form of a roll, and these tend to be greater than the problems encountered with the use of the aluminum foil. Cutting of sections of foil material with scissors, as it was done with paper for wrapping sandwiches, which can be viewed as the predecessor of foil or film, is not practical with foil material. Such foils have therefore long been sold in the form of rolls packaged in cardboard boxes, which serve for storing the roll, on the one hand, and which comprise auxiliary means for cutting off sections of the foil, on the other hand. In most cases, such auxiliary means consist of a saw strip in the form of a thin metal strip similar to the saw blade of a metal saw. Such saw strip extends openly exposed along an opening of the box. However, such foil containers are often found to be quite unhandy: the cylindrical rolls of foil or film turn poorly in the boxes. In addition, as the saw strip must not be too sharp so as to avoid injury, it is necessary to pull the outer end of the unrolled foil with relatively much force for separating sections of the foil. This causes the section of foil to be separated to expand or stretch before the foil material finally tears along the saw-like strip. Due to such overstretching of the foil material, the separated foil later curls within the overstretched area. Another drawback of such foil boxes—which are designed as disposable items—is that they lead to relatively large amounts of metallically loaded waste. Relatively thin and thus flexible cardboard material is used in order to keep the amount of waste small. If such boxes are gripped too strongly, deformation is caused with the result that the roll contained in such a box will turn even more poorly.

Therefore, various devices have long been offered that are not disposable products, and which are intended to make the separation of foil sections easier as compared to the separation process described above.

Some of such devices have saw blade strips like the box mentioned above, along which the sections of foil are separated. For example, FR-2 697 822 A1 describes a device with an elastically deformable plastic cover, in which the roll is received. One edge of the plastic cover is designed in the form of a sawblade-like strip. Said device is handy; however, it has various drawbacks: the roll of foil, for example, is not protected, as it is not contained in the interior of a housing. In addition, the device is normally designed only for right-handed people. The manufacture of a reversely designed device is recommended for left-handed people.

Another device with a saw blade strip is the subject matter of EP-0 023 473 A1. This device has a spike for receiving the core of the roll of foil, such spike being supported between two plates. The device can be set up upright with a vertical or horizontal spike or mandrel. The saw blade strip is freely mounted between the plates as well, with a spacing from the mandrel. With this device, too, the roll is not protected, and the freely exposed saw blade strip is either not adequately efficient or even dangerous.

In addition, devices are known, for example from EP-0 265 552 A1, where the roll of foil is accommodated in housings made of plastic or wood in most cases. The housings have dispensing slots, through which an unrolled end of the foil projects into the outside. The end of the foil is guided via a cutting slot arranged parallel with the dispensing slot, and cut off with a blade, which is displaceable transversely to the foil material or parallel with the axis of the roll, Said devices are relatively complicated and, therefore, costly. Another drawback is that such devices have to be mounted on a wall, for example on the wall of a kitchen. Kitchen walls are covered with ceramic tiles in most cases, and mounting of such devices with dowels inserted in the wall is deemed undesirable on rented premises. It is occasionally proposed to glue the devices to the ceramic tiles. However, their weight, combined with the tensile force applied when the foil is separated from the roll, is generally too high for safe mounting. Furthermore, certain kitchens lack the space for mounting such a device on the wall. In addition, replacing the empty spool by a new roll of foil is mostly complicated in connection with wall-mounted devices. Finally, it has to be taken into account that objects suspended in kitchens always get dirty relatively quickly due to the vapors generated during cooking.

For the above reasons, an attempt was made to create a device in the form of a housing having a blade device and permitting simple separation of foil sections without necessarily having to mount the device on the wall. Such a device is described in DE 43 08 135 A1. The device has an oblong housing with a roll space. The latter has a dispensing slot, through which the free end of the unrolled foil exits from the roll space. Said end of the foil is guided through a cutting slot while resting against the housing, such cutting slot extending parallel with the dispensing slot. A blade serves for separating end sections of the foil. The blade consists of a blade holder and a cutting blade projecting through the cutting slot, said cutting blade having two oppositely acting cutting surfaces orientated in the direction of the cutting slot. The blade holder is guided in a holder guide along the cutting slot; the holder guide is separated from the roll space. Said device offers a number of benefits: it can be kept in a cabinet or drawer and, therefore, will hardly get dirty. The roll is arranged in the stable, cylindrical roll space, so that it is protected and easily rotatable when the foil is unrolled. The blade acts on both sides and, therefore, needs not to be reset after each cutting process. The blade holder guide is separated from the roll space, so that the foil in the form of a roll cannot be damaged when the blade is displaced. Said device nevertheless has a serious drawback as shown by the following description of the way it is handled when an end section of the foil is separated or cut off, the device has to be held with one hand—unless it is mounted on a wall, which, however, is what is to be avoided. The second hand is needed for actuating the blade device. Now, a third hand would actually be needed for gripping the separated section of foil. Due to the absence of such third hand, the separated end of the foil drops down after it has been cut off, for example onto the table, where food and used dishes are present in most cases, or onto the floor. Both situations are undesirable for hygienic and practical reasons. The drawback of said device is consequently obvious.

Therefore, the problem of the present invention is to create a foil dispenser permitting in the free space clean separation of an end section of the foil, whereby the toil dispenser can be held with one hand and the foil section to be cut off can be continuously held with the other hand.

Said problem is solved with a foil dispenser according to the introductory part of claim 1 and its characterizing features.

An advantageous embodiment of the foil dispenser according to the invention is introduced in the following description by reference to the drawings and its function and handling are explained in greater detail. In the drawings, FIG. 1 shows a foil dispenser according to the invention without blade, by an exploded view;

Figures 1, 2, 3:
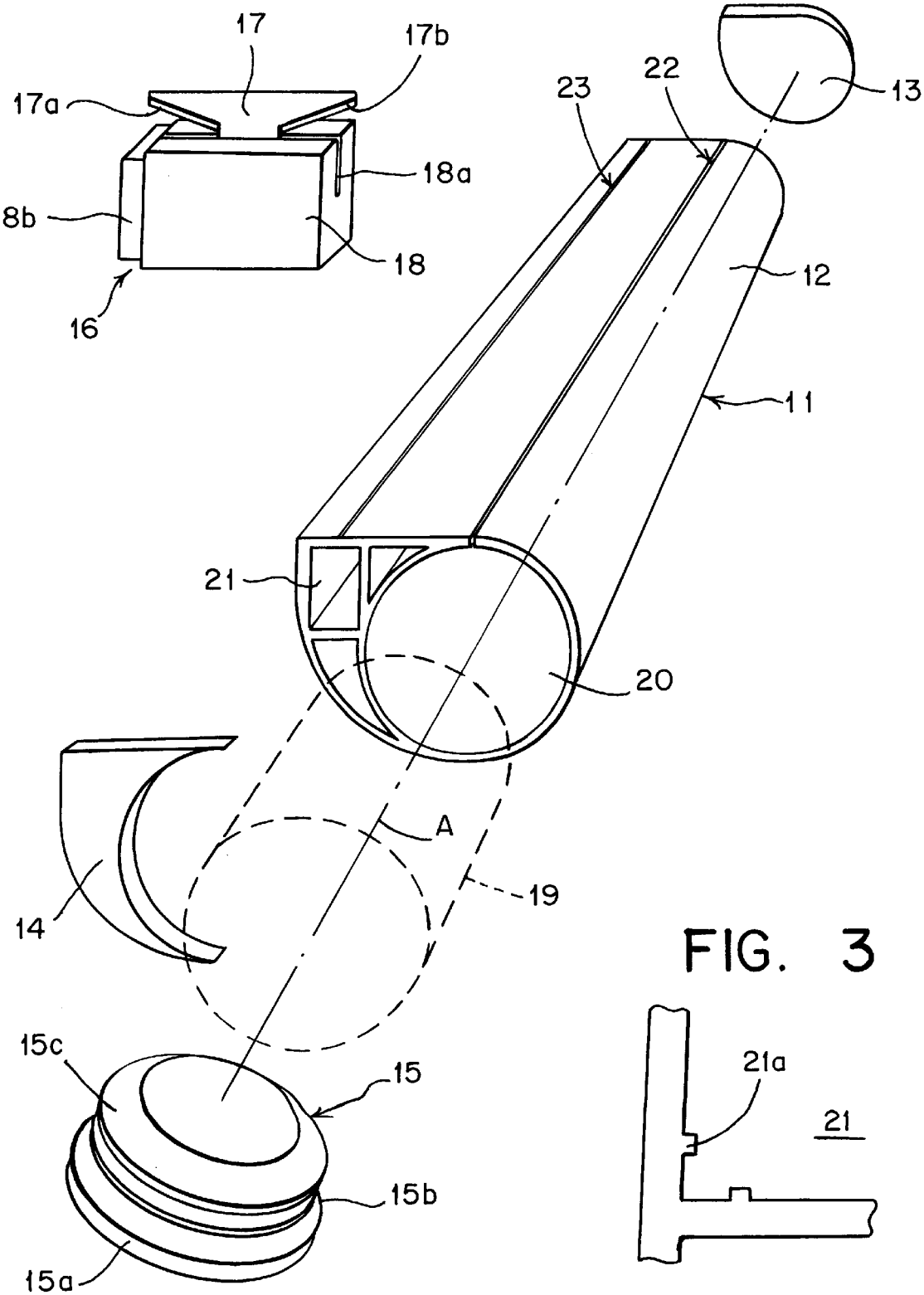
FIG. 2 shows a blade of the foil dispenser according to the invention.
FIG. 3 shows sliding runners in the blade holder guide.

The foil dispenser shown in FIG. 1 has a housing 11 consisting of an oblong housing body 12. The face of the latter is permanently closed with a cover plate 13, and the second face is closed with a partly removable cover device, Said cover device consists of a holder guide cover 14 and a roll chamber cover 15 with spacer part 19. The foil dispenser, furthermore, is comprised of a knife 16 shown in FIG. 2, such knife consisting of a cutting blade 17 with two cutting edges 17*a*, 17*b*, and a blade holder 18.

Figure 5:
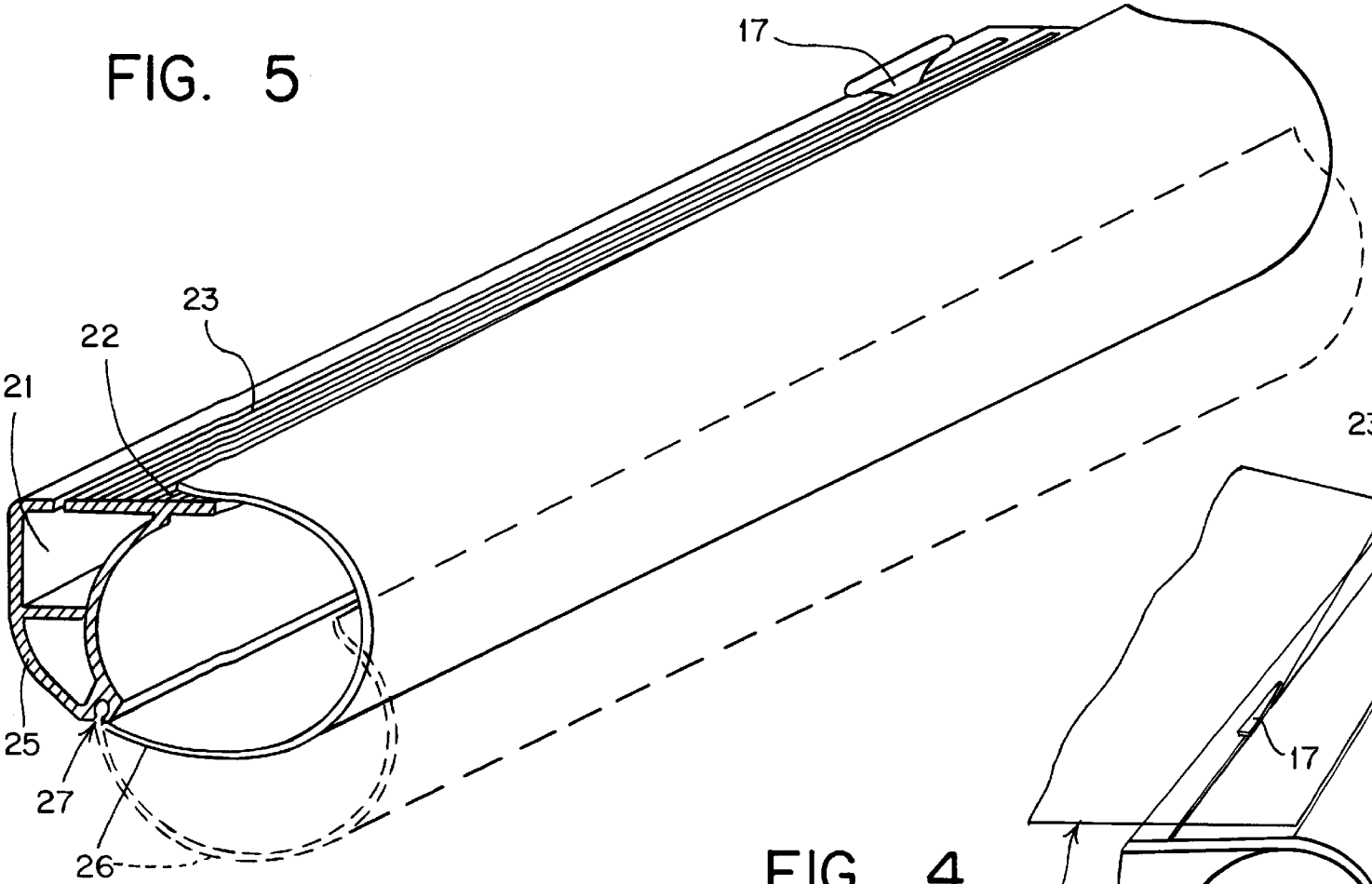
FIG. 5 shows an advantageous design of a housing body.

Housing body 12 has an approximately drop-shaped cross section. It contains a cylindrical roll chamber 20 for a roll of foil (not shown), and a holder guide 21, the latter being separated from roll chamber 20 and extending parallel with said chamber. Within the zone of roll chamber 20, housing body 12 has a through-extending dispensing slot 22, through which end section 10 of the roll of foil is projecting as shown in FIG. 5, where said end section 10 is being cut off. Parallel with dispensing slot 22, housing body 12 has an also through-extending cutting slot 23 within the zone of holder guide 21. In the assembled condition of the foil dispenser as shown in FIG. 5, cutting blade 17 of blade 18 projects through said through-extending cutting slot 23. As shown in FIG. 3, holder guide 21 has runners 21*a* extending in its longitudinal direction. Blade holder 18 slides and is guided on said runners. Alternatively, blade holder 18 could be fitted with runners as well. Housing body 12 preferably consists of a section of an endless profiled rod made, for example of extruded plastic. Sections of the same profiled material cut to length as required can be used for the housing and thus for foil rolls of different lengths as well. Cover plate 13 corresponds with the cross section of housing body 12 and is mounted on the latter, for example by glueing or welding, Holder guide cover 14 consists of a corresponding, plate-shaped molded piece rigidly mounted on housing body 12 like cover plate 13. Said molded part covers the part of the face of housing body 12 not closed by roll chamber cover 15. Roll chamber cover 15 is round and designed in such a way that it can be easily removed, for example like a cover used for medicine vials, i.e., with a rigid cover plate 15*a* and a type of elastic bellows 15*b*, or with an elastic ring element 15*c*.

Knife 16 shown in FIG. 2 consists of a cutting blade 17 and blade holder 18. Cutting blade 17 is mounted in a groove 18*a* of blade holder 18 and has two knife parts facing away from each other. When device 10 is in the assembled condition as shown in FIG. 5, the cutting edges 17*a*, 17*b* of said knife parts extend acute-angled relative to cutting slot 23, facing the latter. Blade holder 18 here consists of a sliding body having the same cross-sectional shape as blade holder guide 21, so that it fits in the latter with little play. It has dampening elements 18*b* on its faces, of which only the one disposed on the left is shown in FIG. 2.

Figure 4:
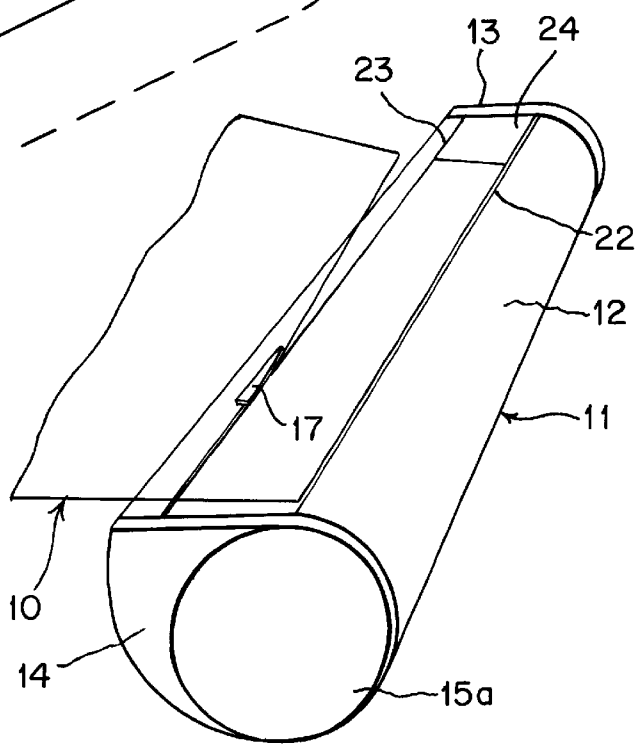
FIG. 4 shows the foil dispenser represented in FIG. 1 in the position it is used, with a partly separated end section of the foil.

The embodiment according to FIG. 4 shows that a start-up segment 24 for the knife is formed in housing body 12. Said start-up segment 24 is required in order to remove the resting knife 16 from the path of the pulled-out foil after the latter has been unrolled and is placed against the outer edge of housing body 12. However, it has another very important function that is fundamental to the present invention and its function: the foil dispenser according to the invention is different from known devices in that when the housing is in a sufficiently inclined position, the knife moves along the cutting slot quasi by itself, i.e., without manual actuation, cutting off the unrolled, free end section of the foil. In other words, the knife moves in the blade holder guide along the cutting slot actuated by force of gravity. For this process, the foil dispenser is held with one hand, whereas the second hand is free for placing the end of the foil against the housing and for holding said end while it is being separated and after it has been cut off. Start-up segment 24, therefore, is an acceleration segment for knife 16 which, before cutting starts, has to be accelerated from the standstill position to such extent that it will continue to move subsequently in spite of the braking effect caused by the cutting resistance. By selecting a housing body 12 whose roll chamber 20 is slightly longer than the roll, start-up segment 24 can be designed as required. So that the roll will always remain at the correct end of roll chamber 20, a spacer part 19 is inserted within the zone of start-up segment 24.

Even though the cutting operation is simple with the help of force of gravity acting on the knife, the conditions under which it can take place flawlessly are limited: on the one hand, the component of the weight of the knife acting in the direction of the cutting slot across a start-up segment, along which no foil is to be cut as yet, needs to overcome the friction between the blade holder and the holder guide, and initially even the static friction, which is higher than the sliding or rolling friction herein referred to as the "motional friction". In addition, across said start-up segment, the knife has to be accelerated to such an extent that it continues to move in spite of the braking effect of the foil, which it impacts. On the other hand, across the cutting distance following the start-up segment, where no static friction prevails as after the start of the knife across the start-up segment, but motional friction, the knife has to additionally overcome the cutting resistance of the foil. The resistance occurring along the cutting path against the movement of the knife is higher than the static friction. Therefore, the mass of the knife has to be selected in such a way that the component of force of the weight of the knife acting in the direction of the cutting slot and the inertia or mass force of the knife overcome the motional friction increased by the cutting resistance caused by the foil material. Furthermore, the start-up distance or segment has to be dimensioned in such a way that it permits adequate acceleration of the knife.

The dynamics of the knife is, of course, substantially influenced by the extent to which the position of the foil dispenser is slanted. The steeper the foil dispenser is maintained the lower the weight of the knife has to be. However, since a very steep position of the foil dispenser poses the risk that the end section of the foil to be cut off cannot be placed against the outside of the housing in a clean way free of folds, it is assumed that the foil dispenser is used in a rather flat position, i.e., with its longitudinal axis inclined by about 15 degree or more, but less than 75 degrees.

If the knife holder is fitted with rollers, the motional friction consists of rolling friction, which is lower than the sliding friction. This means that the weight of the knife could be selected lower than for a sliding knife. However, the less complicated solution (because it is much simpler in terms of engineering) is to design the knife holder in such a way that it moves sliding along the mounting device. The mass of material to be additionally used counts much less with respect to cost expenditure than the relatively complicated manufacture of a rolling blade holder. In addition, sliding blade holders are less susceptible to trouble than rolling ones.

As mentioned above, the start-up segment for the knife has to be dimensioned in such a way that the knife is sufficiently accelerated. A certain—though very limited—start-up segment is obtained without any additional measures if the length of the cutting slot is sufficiently long for allowing complete removal of the knife with a certain spacing from the web of foil while an end section of the latter is unrolling, so that the foil will not in any way get into the resting range of the knife when placed against the housing, even not when it is unrolled with a slight slant. If such distance will not suffice for the start-up segment 24, the sliding slot and thus the entire housing can be extended as required.

As the housing is (as described above) longer than the roll in the axial direction in any case, it is advantageous if a spacer part 19 is arranged in the interior of the roll chamber. Such spacer part serves at the same time as the roll axle and thus fixes the axial position of the roll. By way of example, the spacer part can be a spacing body loosely inserted in the roll chamber. Such a spacing element can be arranged adjoining the one or other face of the housing. The foil dispenser can be designed for both right- and left-handed people by arranging the spacing element in the one or other position as required.

If the knife is designed for moving in a sliding way, the blade holder can be designed in a simple way in the form of a plate. For example, the blade holder may comprise two part plates between which the cutting blade is mounted. Furthermore, a good solution is to design the blade holder in the form of a thicker plate and to arrange the cutting blade in a groove of said plate. In any case, the cutting blade and the blade holder can be designed in the form of one piece. For preventing the removable cover device 14 from being knocked from the housing by blade holder 18 impacting it, and also for dampening the noise of such impact, it is advantageous if blade holder 18 and/or the face sides of the housing are fitted with dampening elements on the surfaces facing each other. For preventing injury by cutting blade 17 projecting from the housing, it is favorable if cutting blade 17 is designed in such a way that its cutting edges 17*a*, 17*b* extend acute-angled relative to cutting slot 23, facing the latter.

The housing is preferably designed in such a way that it integrally contains blade holder guide 21. Except for the face-side parts, the housing can then be manufactured from a section of an endless profiled rod. It would be favorable if the foil dispenser is offered in different colors for receiving different qualities of foil material, between which distinction would otherwise be difficult.

So as to prevent knife 17 from sliding out of the housing when an empty core is replaced by a new roll, it is favorable (as described above) to design the cover device in such a way that it consists of two parts, specifically a roll chamber cover 15 and a holder guide cover 14, whereby the holder guide cover 14 can be permanently arranged on housing body 11, as the useful life of cutting blade 17 generally exceeds the service life of the foil dispenser.

FIG. 5 shows a particularly advantageous housing consisting of two different profile pieces 25, 26. The one profile piece 25 forms the fixed housing part as well as the blade holder guide, whereas a second profile part 26 forms a swinging cover for opening the housing, so that a roll of foil can be easily inserted. The fixed housing part 25 can be laterally closed with covers, i.e., on its face sides, closing the entire face-side space of the closed housing. The swinging cover 26 is longitudinally inserted in a groove 27 on the other housing part 25, in which it is swinging around the longitudinal axis of the groove. Said cover part 26 is advantageously designed in such a way that when it is closed by swinging, it is locked on the other housing part 25 by means of snap closures. When cover part 26 is open, the roll of foil is placed into the housing in such a way that it can be unrolled in the illustration shown counterclockwise, whereby the end section is formed by dispensing slot 22 between the outer edge 28 of cover part 26 and the fixed housing part 25. Blade 17 again projects from cutting slot 23 and is mounted on the blade holder, which can be easily moved back and forth in blade holder guide 21.

Such a foil dispenser according to the invention is simple, inexpensive to manufacture, and handy when used. It can be stored in a space-saving way, easily cleaned, refilled without problems, effortlessly handled, and it delivers precisely cut end sections of the foil without distorted parts. As said foil dispenser is much more practical in every respect than known devices, plastic films or foils will certainly be used in increased amounts instead of the ecologically undesirable aluminum foil materials, which are frequently used because they could be handled heretofore in a much better way than plastic foils. Another ecological advantage of the foil dispenser is that replacement rolls can now be offered no longer in complicated boxes with saw blade strips, but in much more favorable refillable packagings.

What is claimed is:

1. A foil dispenser for storing a foil coiled as a roll, and for cutting off and dispensing end sections of the foil, said foil dispenser comprising:

a housing body having at least one face side being closed by an operable cover device, said housing body including a roll chamber with a longitudinal axle for receiving a roll of foil to be inserted therein, said housing body further having a dispensing slot parallel with its longitudinal axle through which an unrolled end of the roll of foil is guidable, and a cutting slot being parallel with the dispensing slot over which the unrolled end of the roll of foil is able to be placed;

a cutting blade holder being movable in a blade holder guide arranged along the cutting slot of said housing body, said blade holder guide being an integral part of said housing body;

a double-edged cutting blade of a knife not having a handle, said cutting blade acting in the direction of the cutting slot of said housing body and being supported by said cutting blade holder, with said cutting blade holder extending in a longitudinal direction beyond an end of an adjacent roll of foil in an extension intended for receiving said cutting blade holder when not in use, said extension simultaneously forming a start-up segment for the knife, in which said cutting blade holder forms an acceleration mass so that, when holding said foil dispenser with sufficient inclination of said blade holder guide, said cutting blade holder, with the knife, is displaceable along said blade holder guide via sliding, or rolling, solely by action of gravitational force, thereby cutting a portion of the roll of foil placed across the cutting slot.

2. Foil dispenser according to claim 1, wherein the blade holder includes a sliding body with the blade holder and the sliding body having a cross-sectional_shape for allowing the blade holder and the sliding body to slide within the blade holder guide, with the blade holder having a groove, in which a knife with two knife parts each having a cutting edge is inserted, whereby said cutting edges extend acute-angled relative to the longitudinal direction of the sliding body, facing the latter.

3. Foil dispenser according to claim 1, wherein the housing includes two different profile pieces, the one profile piece forms the fixed housing part and the blade holder guide, and is closed on its face sides with covers closing the entire face-side space of the closed housing, whereas the second profile piece forms a swinging cover for opening the housing, whereby said cover is lengthwise pushed into a groove on the other housing part, in which groove it is pivotable around the longitudinal axis of such groove.

4. Foil 1 dispenser according to claim 1 wherein the housing is formed by one or several sections of endless profile rods preferably made of extruded plastic.

5. Foil dispenser according to claim 1, wherein the cover device for closing the open face side of the housing body comprises a first holder guide cover closing the holder guide, and a second roll chamber cover closing the roll chamber, and that on the other face side, a spacer part is inserted in the roll chamber.

6. Foil dispenser according to claim 1 wherein the blade holder has rollers, on which it is displaceable in the blade holder guide in a rolling way.

7. Foil dispenser according to claim 1, wherein the blade holder has dampening elements on its face sides for dampening noise and shock when the blade holder reaches an end of said blade holder guide via sliding or rolling.

* * * * *